US005100138A

United States Patent [19]

Wilde

[11] Patent Number: 5,100,138

[45] Date of Patent: Mar. 31, 1992

[54] MOTORIZED MOBILE BOXING ROBOT

[76] Inventor: Mark S. Wilde, 16 Stillforest, Houston, Tex. 77024

[21] Appl. No.: 554,698

[22] Filed: Jul. 18, 1990

[51] Int. Cl.[5] ..... A63B 67/00; A63B 69/00

[52] U.S. Cl. ..... 273/85 R; 273/85 F; 901/1; 482/84; 482/87; 482/7; 482/4

[58] Field of Search ..... 273/85 R, 85 F, 1 R, 273/1 F, 1 G; 446/330-336; 901/1; 180/6.5, 907; 414/718, 914, 722; 272/76

[56] References Cited

U.S. PATENT DOCUMENTS

| | | | |
|---|---|---|---|
| 3,093,372 | 6/1963 | Cirami | 180/8.6 X |
| 3,199,249 | 8/1965 | Carver et al. | 901/1 X |
| 3,250,533 | 5/1966 | Nicholson | 272/76 |
| 3,648,408 | 3/1972 | Terzian et al. | 901/1 X |
| 3,969,841 | 7/1976 | Joseph | 446/334 |
| 4,046,262 | 9/1977 | Vykukal et al. | 901/1 |
| 4,163,567 | 8/1979 | Barber | 180/6.5 |
| 4,295,779 | 10/1981 | Shumaker | 414/722 X |
| 4,299,301 | 11/1981 | Janin | 180/6.5 |
| 4,307,891 | 12/1981 | Doornick et al. | 901/14 X |
| 4,593,900 | 6/1986 | Burke | 272/76 |
| 4,626,164 | 12/1986 | Chang | 901/1 X |
| 4,705,449 | 11/1987 | Christianson et al. | 180/6.5 X |
| 4,736,826 | 4/1988 | White et al. | 901/1 X |
| 4,765,609 | 8/1988 | Wilson et al. | 272/76 |
| 4,844,461 | 7/1989 | Namanny et al. | 273/85 R |
| 4,854,811 | 8/1989 | Veys | 414/718 |

*Primary Examiner*—Edward M. Coven
*Assistant Examiner*—Sebastiano Passaniti
*Attorney, Agent, or Firm*—Kenneth A. Roddy

[57] ABSTRACT

A motorized mobile robot carries a person and is articulated and controlled by joysticks and foot pedals or by remote control to simulate the sport of boxing by effecting punches and blocks upon a like robot. Fluid motor driven wheels propel the robot in forward, rearward, lateral, turning, and spinning movements. An upper frame above the wheel base defines an enclosure having a generally humanoid configuration including a torso with an interior seat for supporting a person within the enclosure in a sitting position. A pair of independently movable arm assemblies connected at each side of the torso are driven by fluid actuators and each has a shoulder portion pivotally movable relative to the torso, an upper arm portion pivotally movable relative to the shoulder portion, and a forearm portion pivotally movable relative to the upper arm portion with a padded boxing glove at the outer end. A head member is movably mounted on the torso and a scoreboard on the torso indicates the number of times the head has been pivoted rearwardly by blows delivered by an opponent to determine the winner of a boxing match. A proximity control allows arm movement only when one robot is in a predetermined position relative to a like robot.

20 Claims, 6 Drawing Sheets

MOTORIZED MOBILE BOXING ROBOT

BACKGROUND OF THE INVENTION

1. Field of the Invention

This invention relates generally to amusement vehicles and articulated robot apparatus, and more particularly to a motorized mobile boxing robot adapted to carry a person and articulated to effect punches and blocks upon a like robot to simulate the sport of boxing.

2. Brief Description of the Prior Art

There are several patents which disclose devices which simulate boxing. Toy boxing figures are taught by U.S. Pat. No. 3,969,841 to Joseph and U.S. Pat. No. 2,538,744 to Berry. Full size upper robotic torsos used in sparing exercises are taught by U.S. Pat. No. 4,765,609 to Wilson et al and U.S. Pat. No. 4,593,900 to Burke. Namanny et al, U.S. Pat. No. 4.844,461 teaches a larger version of toy boxing figures used for a competitive sport. Prior art boxing simulation devices teach viewpoints from the outside looking in or down at a boxing match.

To accurately simulate a given environment, the vantage point of the person involved should be from within the environment looking out. For example, a boxer looking at his opponent is a basic requirement to bring out the actual human drama in the act of boxing. The present invention relates to a robotic machine which a person can operate from inside the structure to simulate the competitive sport of boxing with reduced risk of injury and offers a more accurate simulation environment in regards to the sport of boxing.

SUMMARY OF THE INVENTION

It is therefore an object of the present invention to provide a simulation environment for the sport of boxing which utilizes a robotic machine interface system which carries a person.

It is another object of this invention to provide a robotic boxing machine which can move about and box on a level surface under it's own power and has an upper torso with independently controlled arm and shoulder assemblies.

Another object of this invention is to provide a mobile boxing robot capable of pivoting while throwing a punch, spinning away from an opponent's punch, and gaining a strategic mobility sequence during a simulated boxing match which gives the operators a sense of the boxing sport which until now was only known to real boxers themselves.

Other objects of the invention will become apparent from time to time throughout the specification and claims as hereinafter related.

The above noted objects and other objects of the invention are accomplished by a machine with the capability to encompass, protect, and mobilize a person situated within the machine itself. The user, in a sense, puts on a suit of armor capable of throwing punches and blocking punches. A pair of the present mobile boxing robots having a wheel driven base can be operated in a roped off area approximately twenty feet square to allow manueverability. One person operates one robot against another person in a like robot for a predetermined length of time and the winner of the match being the person scoring the greatest number of punches to the head area of the opponent.

The boxing robot machine is comprised of a motorized base with an upper robotic torso structure having a pair of anthropomorphic like arm and shoulder assemblies juxtaposed at each side of the upper torso area. A person sits inside the upper torso and operates the robot. A pair of independently controlled hydraulic motors drive a rotatable wheel mechanism in the mobile base structure which allow the robot to move sideways, as well as forward, backward, turns, and spins. Arm and shoulder movement is powered through pneumatic actuators and a crank arm arrangement capable of a quick and action oriented arm punching cycle controlled by a pushbutton from within the robot by the person sitting therein.

An upper arm linkage assembly forms the basis for arm punch motion whereby the upper arm portion swings from a vertical position to a horizontal position and carries a forearm link which pivots relative thereto such that when the entire arm linkage moves from a vertical position to a punch position, the forearm link thrusts forward. The forearm portion terminates in a boxing glove. A simulated blocking movement to defend against punches is accomplished by holding the forearms fixed in a vertical position while the upper arm is rotated to a generally horizontal position. The arm assemblies are mounted on a shoulder assembly such that the arms can be canted inward to provide a total of three axis of movement for greater freedom of movement and punching accuracy. Arm movement is further controlled by electronic timing circuitry to provide an automatic timed cycle of arm movement from the in to the out and back to the in position. This feature allows less skied operators to through punches with a quick and clean motion.

An infrared proximity sensing and system on the front of each robot allows arm punching only when one robot is adjacent or facing another robot. Unless the infrared detector of one robot sees the sensor of another robot, the arm circuitry will be switched off until the robots are once again facing each other. The proximity sensing system prevents the operators from punching at the opponent's side or rear which is not allowed in this simulatory exercise or in the actual sport of boxing.

In another embodiment of the invention control of the robot is accomplished by a radio frequency type transmitter and receiver which allows a person to control the robot from a remote distance.

DESCRIPTION OF THE PREFERRED EMBODIMENT

Figure 1:
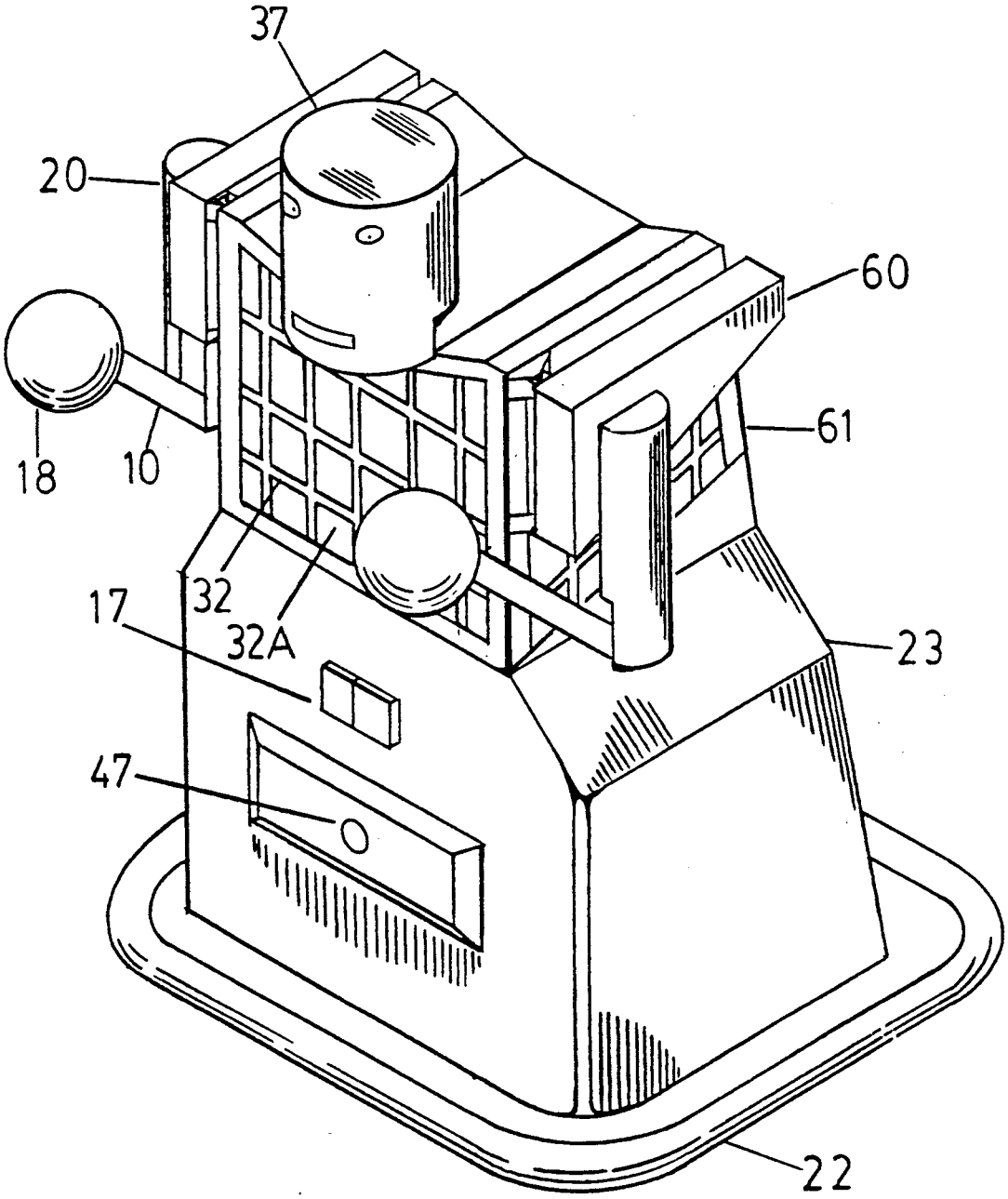
FIG. 1 is a perspective view of a preferred boxing robot machine in accordance with the present invention.
Figure 2:
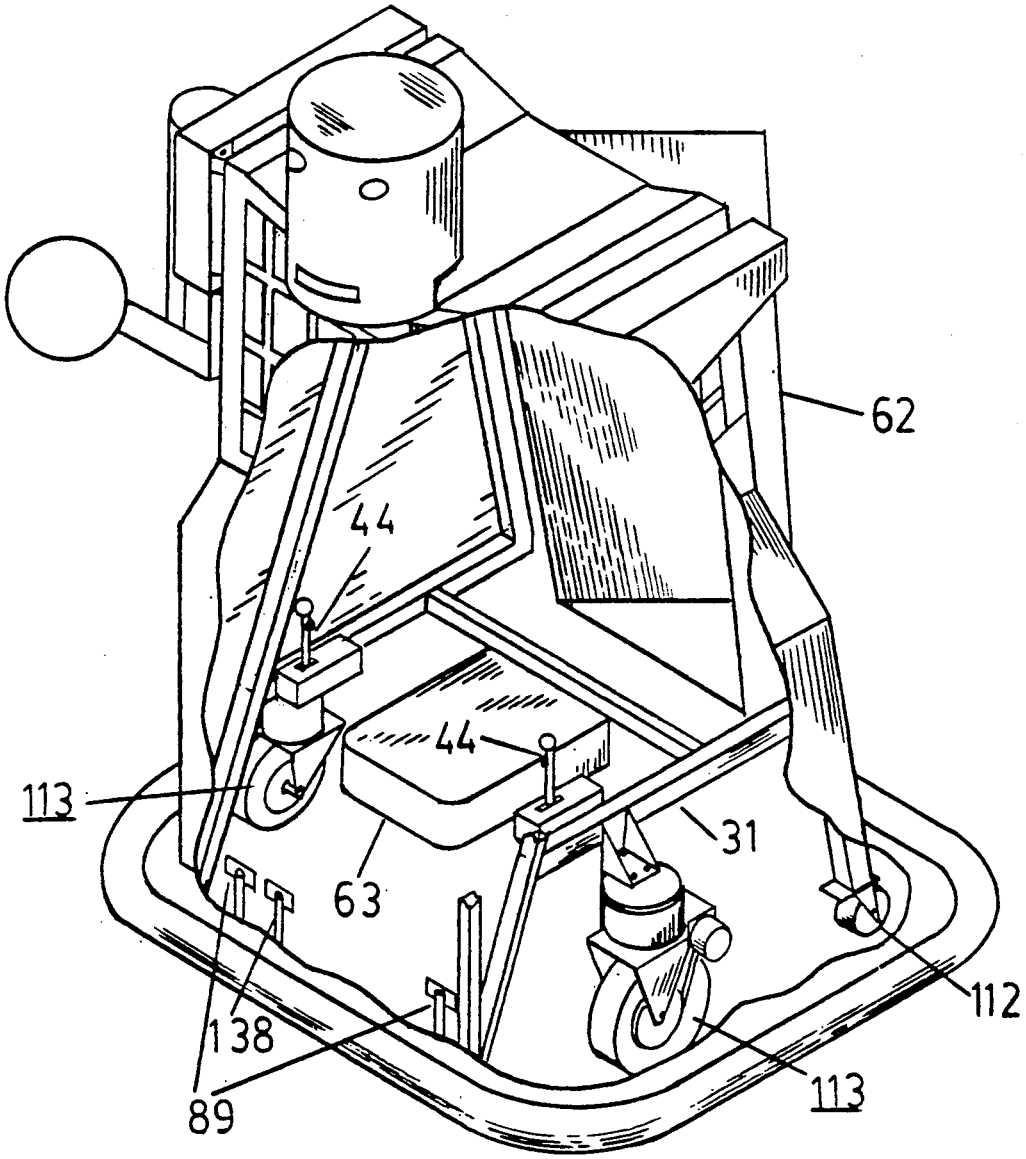
FIG. 2 is perspective view of the boxing robot with a portion cut-away to show some of the internal components.

Referring now to FIGS. 1 and 2, a preferred boxing robot machine is shown. The major components of the boxing robot will be described first followed by a detailed description of the components and their operation. The boxing robot machine has a motorized base 31 with an upper robotic torso frame 61 having a pair of anthropomorphic-like shoulder assemblies 60 movably mounted at each side of the upper torso area and a head member 37 pivotally mounted at the top end thereof.

Each shoulder assembly 60 has an upper arm 20 and forearm portion 10 with a padded glove 18 at the end of the forearm. The arm and shoulders are articulated and driven by pneumatic operators to simulate punching and blocking movements. A pair of independently controlled hydraulic motors drive a rotatable wheel mechanism 113 mounted in the base which allow the robot to move sideways, as well as forward, backward, turns, and spins. A person enters the robot structure through a door 62 and sits on a seat 63 inside the upper torso and operates joysticks 44 and foot pedal switches 89 and 138 to control the operation of the robot.

A fiberglass body shell 23 encapsulates the entire lower proximity of the operator and all drive system structures. A grating 32 on the upper torso 32 having openings 32A protects the operator and allows an adequate view. While grating 32 is depicted as being constructed out of welded tubes, better visibility may be provided by using a high strength, bullet-proof clear plastic glazing. To provide the necessary cushioning upon the robots colliding with each other during a boxing match, a bumper 22 is secured around the periphery of the lower area of the robot. A scoreboard 17 located at the front of the shell 23 is used in tallying the score and an infrared module 47 is used in proximity control during a boxing match. The robot thus has an anthropomorphic look and persons operating the robots will be able to simulate to a greater degree the realism of actually, physically participating in a real boxing match as they look upon an opponent's robot.

Figure 8:
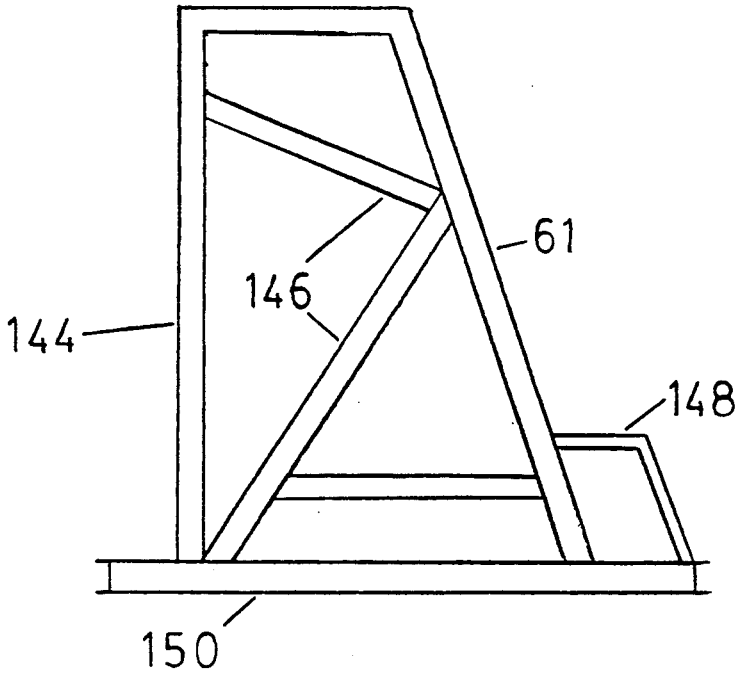
FIG. 8 is a side elevation of the frame structure of the boxing robot machine.

Referring additionally to FIG. 8 there is shown a rear step member 148 whereby a person can climb up and into the robot through the door 62 and sit upon the seat 63. All of the control mechanisms of the robot are within easy reach and the robot is sized such that persons large and small will be able to operate it easily. A front frame 144 braced by diagonal supports 146 located on top of a bumper frame 150 provides sufficient structural strength and rigidity to provide the operator with a safe environment against the opponent's punches, and colliding efforts during a boxing match. The structure will generally be constructed of steel tubes welded together providing ease of assembly, light weight, and good durability.

Figure 6:
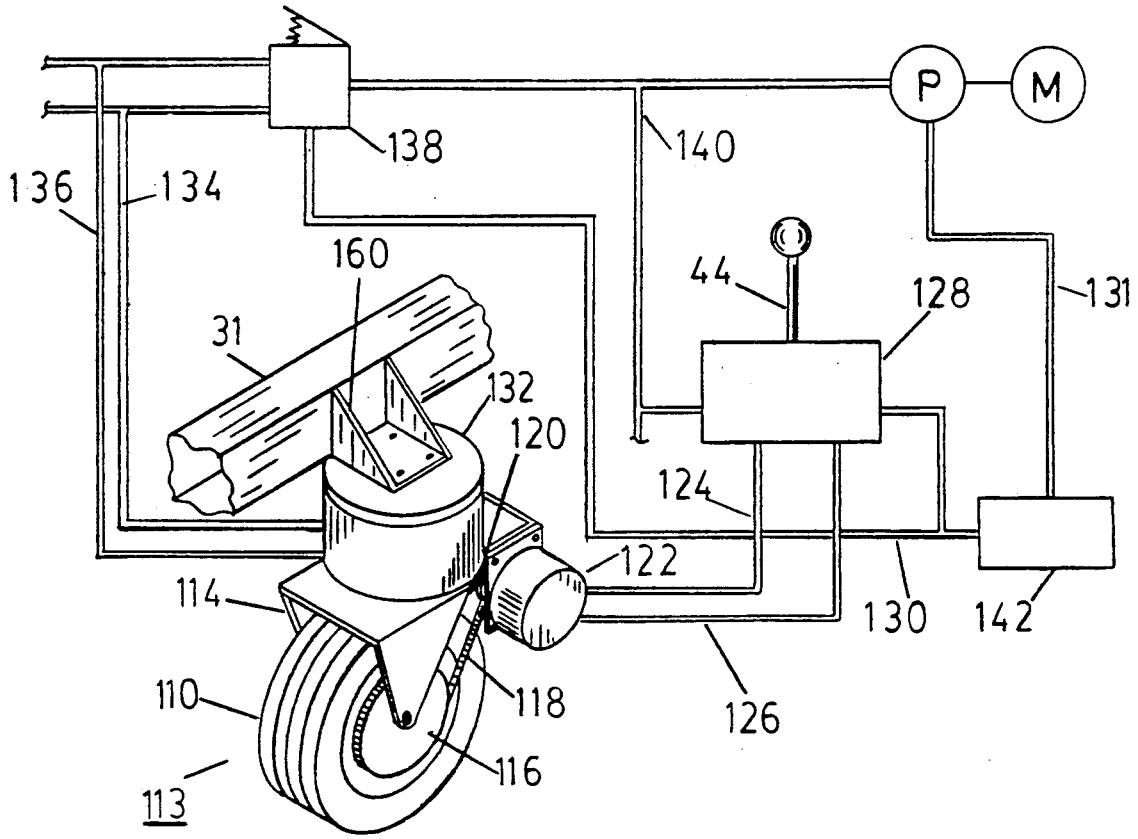
FIG. 6 is an isometric view of one rotatable drive wheel of the robot illustrating schematically the fluid power circuitry for one side of the robot.

Referring now to FIGS. 2 and 6, the mobile robot drive system will be described in detail. A pair of hydraulically driven, independently operated wheel groups 113 are disposed at the lateral sides, and generally to the front of the base 31. Each wheel group comprises a hydraulic 90° rotary actuator 132 connected at its top end to a bracket 160 secured to the frame 31 and a wheel frame 114 secured to the bottom end of the rotary actuator 132. A drive wheel 110 having a chain sprocket 116 is rotatably mounted on the wheel frame 114. A hydraulic motor 122 is secured to the wheel frame 114 and has a drive sprocket 120 connected to the wheel sprocket 116 by a roller chain 118 to rotate the wheel and provide propulsion for the robot. To properly support the rear or back side of the robot, a pair of swivel casters 112 are disposed at both rear corners of the frame to provide a level, balanced, rolling support.

A hydraulic fluid reservoir 142 connected by conduit 131 to a pump P driven by a motor M is housed within the robot frame to supply pressurized fluid to each wheel group. A hydraulic control valve 128 operated by a joystick 44 is connected to the pump P through supply conduit 140 and to the hydraulic wheel motor 122 through conduits 124 and 126. Upon pushing the joystick 44 forward, pressurized hydraulic fluid flows through supply conduit 140 into the control valve 128 thru inlet conduit 124 causing the wheel motor 122 to run clockwise. Upon pulling the joystick 44 in the the opposite direction, pressurized hydraulic fluid flows thru inlet conduit 126 resulting in the wheel motor 122 running in a counterclockwise direction. In the preferred embodiment the sprocket ratios are 2 to 1, and the wheel motor 122 is of the low speed, high torque output variety.

A manual foot pedal valve 138 is connected to the supply conduit 140 and to the 90° rotary actuator through conduits 134 and 136 and to the reservoir 142 through return conduit 130. Pressing the foot valve 138 causes pressurized hydraulic fluid from supply line 140 to flow thru inlet conduit 134 to the actuator 132 causing the wheel frame to rotate.

Since each hydraulic wheel motor 122 is independently controlled by the control valves 128, directional movements of the robot are many. Forward and rearward motions are accomplished by pushing both joysticks 44 forward for moving forward, alternatively pulling both joysticks 44 rearward causes the robot to go backwards. Turns and spinning motions are brought about by pushing one joystick forward while pulling the other joystick rearward, thus causing each wheel 110 to rotate in an opposite direction thereby initiating a hard turn, or a spin if the joysticks are held in an opposite condition for a long enough time.

Figure 7A:
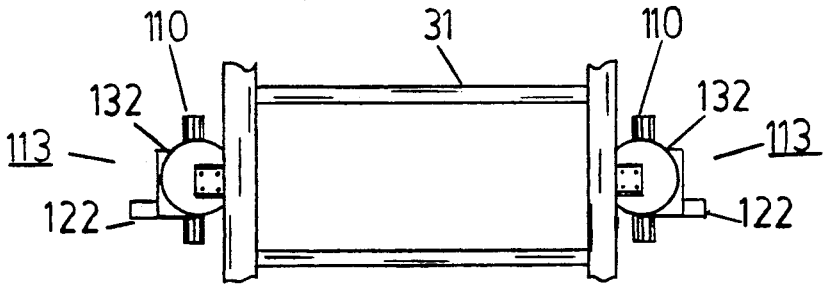
FIGS. 7A and 7B are top plan views of the drive wheel assemblies positioned for forward and sideward movement, respectively.
Figure 7B:
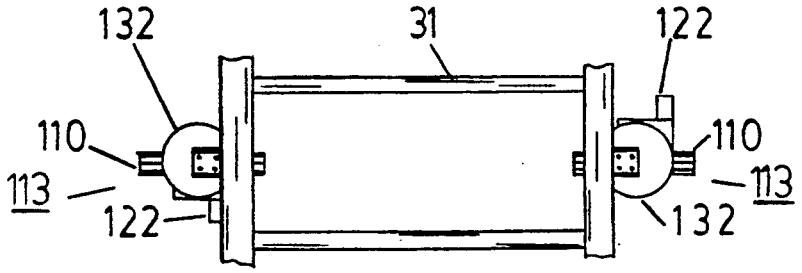

For the purpose of simulating the mobility of an actual boxer, the robotic boxer should have an added degree of mobility, especially in terms of moving side to side. This is accomplished by the 90° rotary actuators 132 on each wheel group 113. By pressing the foot valve 138, pressurized hydraulic fluid from the supply conduit 140 flows thru the inlet conduit 134 to the rotary actuator 132 causing it to rotate about a vertical axis in a counterclockwise manner as viewed from above in FIGS. 7A and 7B. Therefore after the wheel group 113 rotation, side to side motion can now be activated as seen in FIG. 7B. By pushing both joysticks 44 forward, both wheels 110 will rotate in the same direction i.e. clockwise, thereby moving the boxer to the left, conversely, pulling both joysticks 44 rearward will rotate both wheels in a counterclockwise direction, thus causing the robot to move straight to the right. When the foot valve 138 is released pressurized fluid flows thru inlet conduit 136 to the rotary actuator 132 and the entire drive wheel assembly returns to the standard forward and rearward position as seen in FIG. 7A. The hydraulic system flows the return (or low pressure) fluid back to the reservoir 142 through the return conduit 130 and completes the cycle by flowing through conduit 131 to pump P.

Figure 4A:
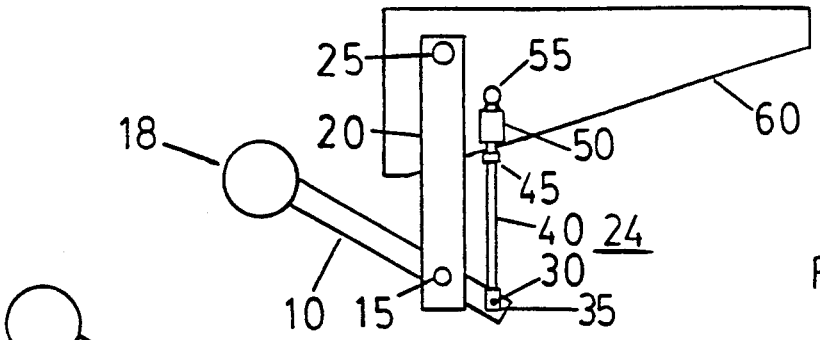
FIGS. 4A, 4B, and 4C are side elevations of the arm and shoulder assembly of the robot at various positions of extension and retraction.
Figure 5:
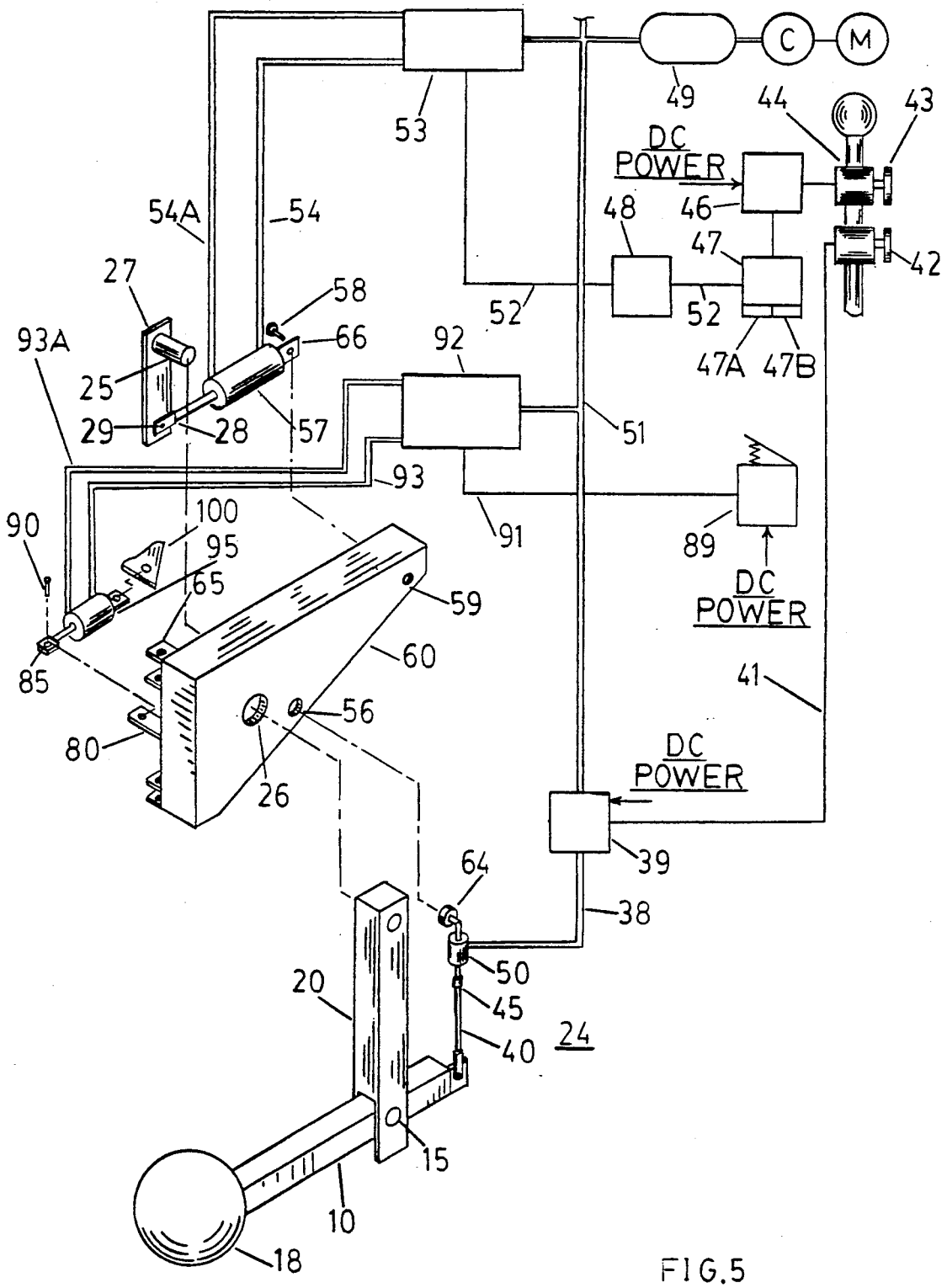
FIG. 5 is an exploded view of one arm and shoulder mechanism illustrating the electronic control interface and fluid power circuitry.

Referring now to FIGS. 4A and 5, a detailed description of the shoulder and arm assembly will be undertaken. Each shoulder assembly comprises a generally triangular shoulder member 60 having a rectangular upper arm member 20 connected at its upper end to the shoulder member 60 and a rectangular forearm member 10 is pivotally connected at the lower end of the upper arm 20 by a pivot pin 15 to form an elbow. One end of the forearm member 10 extends a short distance beyond the pivotal connection and is provided with a clevis 35. A simulated boxing glove 18 is secured to the outer end of the forearm member 10. The gloves 18 are formed of durable, high strength flexible plastic material to give a cushioning effect.

An pneumatic elbow actuator 50 is pivotally connected at one end by a pivot mount 55 to the shoulder member 60. The pivot mount 55 comprises a rotating bushing 64 received an aperture 56 on the shoulder member 60. A collar 45 at the opposed end of the actuator 50 is connected to one end of a link 40 and the other end of the link is pivotally connected to the forearm clevis 35 by pivot pin 30. The members 30, 35, 40, 45, and 50 form an elbow link assembly 24.

A pneumatic dual arm actuator 57 is pivotally connected by a pivot mount 66 at one end to the interior of the shoulder member 60 by pivot pin 58 secured in a pin bore 59. A clevis 28 at the end of the actuator rod is pivotally pinned to the lower end of a rectangular crank arm 27 by pivot pin 29. A shoulder pivot shaft 25 extends outwardly from the upper end of the crank arm 27 and is rotatably received through an aperture 26 in the shoulder member 60. The upper end of the upper arm member 20 is secured onto the outwardly extending end of the shaft 25 to rotate relative to the shoulder member 60. Actuator 57 delivers rotational force through the crank arm 27 to the upper arm 27. FIG. 4A shows the arm assembly in the neutral position.

Figure 4B:
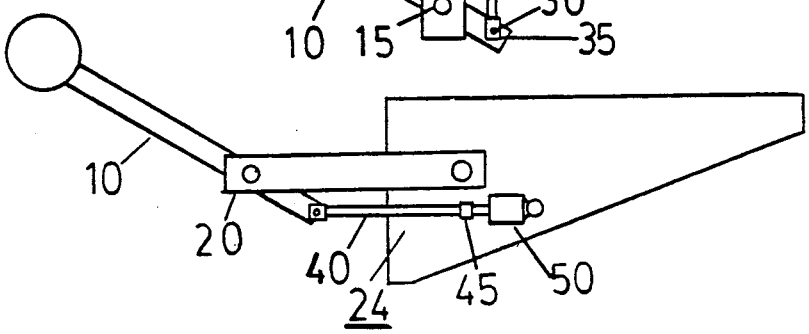
Figure 4C:
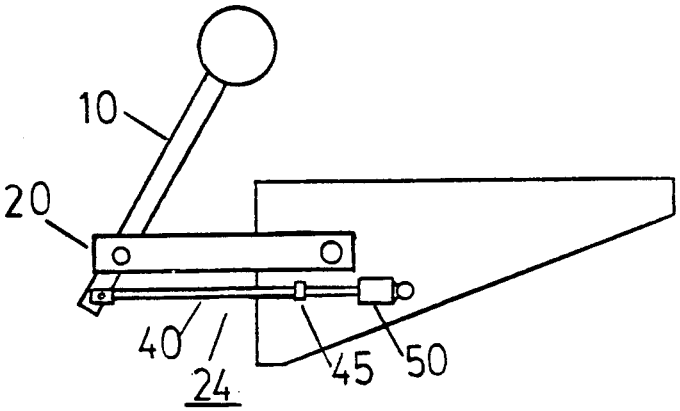
Figure 4D:
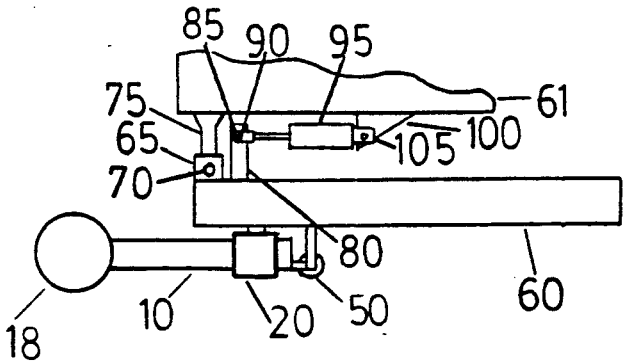
FIGS. 4D and 4E are a top plan view and side elevation, respectively, showing the arm and shoulder assembly of the robot being pivoted inwardly relative to the torso portion.
Figure 4E:
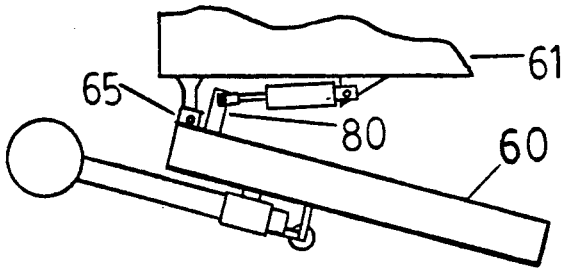

Referring now FIGS. 4D, 4E, and 5, a pair of shoulder brackets 65 extend outwardly from the shoulder member 60 and are pivotally connected by a bolt to a bracket 75 secured to the frame 61. A shoulder pivot arm 80 extends outwardly from the shoulder member 60. A pneumatic shoulder actuator 95 is pivotally pinned at one end by pivot pin 105 to an actuator mount 100 secured to the frame 61. The outer end of rod of the actuator 95 has a clevis 85 pivotally connected to the shoulder pivot arm 80 by pivot pin 90.

Each actuator 57, 95, and 50 is powered by compressed air delivered by an air compressor C driven by a motor M located in the torso. An air reservoir 49 stores this compressed air to be distributed through a supply hose 51 and enters the inlet side of each actuator as determined by a series of solenoid valves. An arm solenoid valve 53 is controls the dual arm actuator 57 through conduits 54 and 54A, a shoulder solenoid valve 92 controls the shoulder actuator 95 through conduits 93 and 93A, and an elbow solenoid valve 39 controls the elbow actuator 50 through conduit 38.

The arm solenoid valve 53 is connected by lead 52 to a source of D.C. power through a logic module 46 coupled with the infrared source 47A and sensor 47B of the infrared proximity module 47 and through a timer module 48. Each joystick 44 is provided with a pair of pushbuttons 42 and 43. Pushbutton 43 is the punching button and is connected to the logic module 46 to control operation of arm solenoid 53 and dual arm actuator 57, as described hereinafter. Pushbutton 42 is the blocking button and is connected to the elbow solenoid valve 39 to control operation of the elbow actuator 50.

The following is a description of the sequence of operation to allow the robot to throw a punch. The operator, upon pressing the punch button 43 located on one of the joysticks 44, will activate the logic module 46. Since only one arm at a time can deliver a punch, the logic module 46 determines which arm (right or left) has priority to be activated in case the person presses both punch buttons 43 simultaneously. Electrical current is sent thru lead 52 to the infrared module 47 which in turn activates the infrared source 47A to emit an infrared beam projected straight out from the robot's frontal area. When two robots in a match are facing each other, or are adjacent at a position whereby the infrared beam projected from one robot aligns with the infrared detector 47B of a second robot, the infrared module 47 of the second robot is activated to signal a positive condition allowing it to throw a punch. Similarly, the first robot will function in a like manner when infrared beam detection is acknowledged. The infrared system is used to negate any attempt of persons operating the robots to try to punch an opponent's robot from the side area or rear area, since infrared beam detection is only possible from the frontal areas of the robots.

Refering again to FIGS. 4A, 4B, and 5, current once passed by infrared module 47 travels through lead 52 to the timer module 48 where the arm punch motion, or cycle, is automatically timed to give quick, clean punches even though the operator of the robot may be quite unskilled. Thus, a timed electrical current travels through lead 52 to the arm solenoid valve 53 actuating it to allow high pressure air to flow through conduit 54 to the dual arm actuator 57 causing it to extend quickly thereby imposing a rotary torque on the shoulder shaft 25. Simultaneously, low pressure air will flow through conduit 54A back to valve 53 to be vented to the atmosphere. As shown in FIG. 4B, upper arm 20 will then rotate clockwise through a 90° arc, as will the elbow link assembly 24 to result in a forward translation of forearm 10 due to the arc of the link assembly 24. In other words, forearm 10 will rotate about upper arm 20 thru pivot assembly 15 in a counterclockwise motion.

Upon releasing the punch button 43, arm solenoid valve 53 switches back to standby, and high pressure air flows through the conduit 54A to contract the dual arm actuator 57 and rotate the arm assembly back to its neutral position (FIG. 4A.).

In the blocking of an opponent's punch, as is common in the sport of boxing, the forearm of a boxer must be positioned generally in an upward or vertical position. This action will help assure that an opponent's punches will not land upon ones head or facial areas during the boxing match. As best seen in FIGS. 4C and 5, to simulate this aspect of the sport robotically, the elbow actuator 50 is actuated to extend the elbow link assembly 24 after the upper arm 20 has translated thru its 90° rotation. Upon the operator depressing the blocking button 42, an electrical current is sent through lead 41 to the elbow solenoid valve 39 which is then opened allowing pressurized air to flow through outlet conduit 38 into the elbow actuator 50 causing it to extend. The elbow actuator 50 is what is commonly referred to as a single acting actuator with a return spring on the inside, thus for our purpose air pressure will extend the actuator, while spring force will retract the actuator when pressure is released by releasing button 42.

Referring now to FIGS. 4D and 4E, it can be seen that each shoulder and arm assembly can be caused to rotate inwardly and outwardly about a vertical axis to allow the forward end of the arms to move inwardly toward the front of the torso portion of the robot. Upon the operator depressing one of the foot pedal switches 89, electrical current is sent through lead 91 to the shoulder solenoid valve 92 thereby allowing it to open and send high pressure air through conduit 93A and low pressure air through conduit 93 causing the dual shoulder actuator 95 to retract and pull on shoulder pivot arm 80. This initiates a torque upon the shoulder member 60 causing it to pivot about the bolt 70 resulting in an inwardly angular position depicted in FIG. 4E.

It should be appreciated that each offensive and defensive articulation of the robot's arms are independently actuated so that in order for one to build up to a given skill level will require some practice. Also, it should be noted that each arm and shoulder unit of the robot achieves a total of three degrees of freedom. The large shock loads resulting from the robots fighting, and striking one another with the various arm articulations are cushioned to a great extent through the use of the pneumatic actuators in the various arm linkages, since pneumatic fluid power systems tend to be extremely compressible, and thus able to absorb much of the shock.

Figure 3:
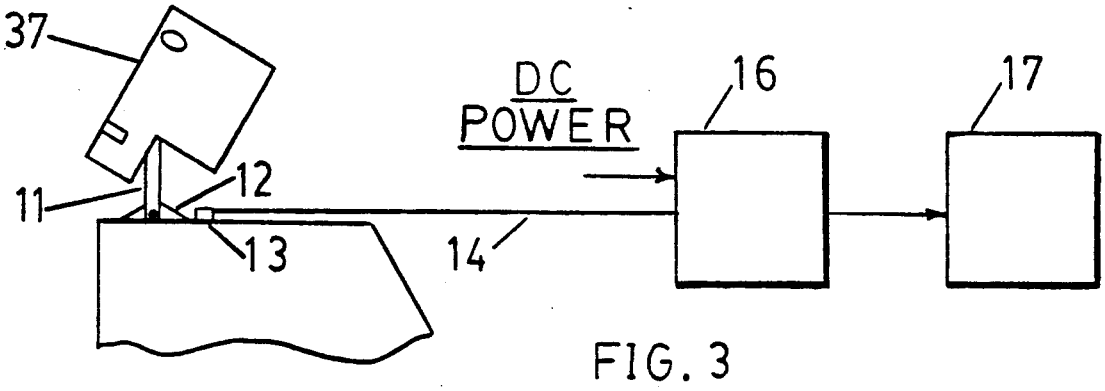
FIG. 3 is side elevation view of the scoreboard display shown with the head portion of the robot in a knocked-back position.

The main objective in the boxing match simulation is to knock the head 37 of the opponent's robot back to score a point. As seen in FIG. 3, the head 37 of the robot has a head bracket 11 pivotally connected to the torso by a pivot bracket 12. A limit switch 13 is secured to the torso rearwardly of the head such that upon receiving a suffiently hard punch from an opponent, the head 37 will pivot backwards and trigger the limit switch 13 which sends a current thru lead 14 to a totalizer 16 to register a point on the scoreboard 17. Thus, the operator, within a given boxing match time period, who has accrued the most points will be the victor.

Figure 9:
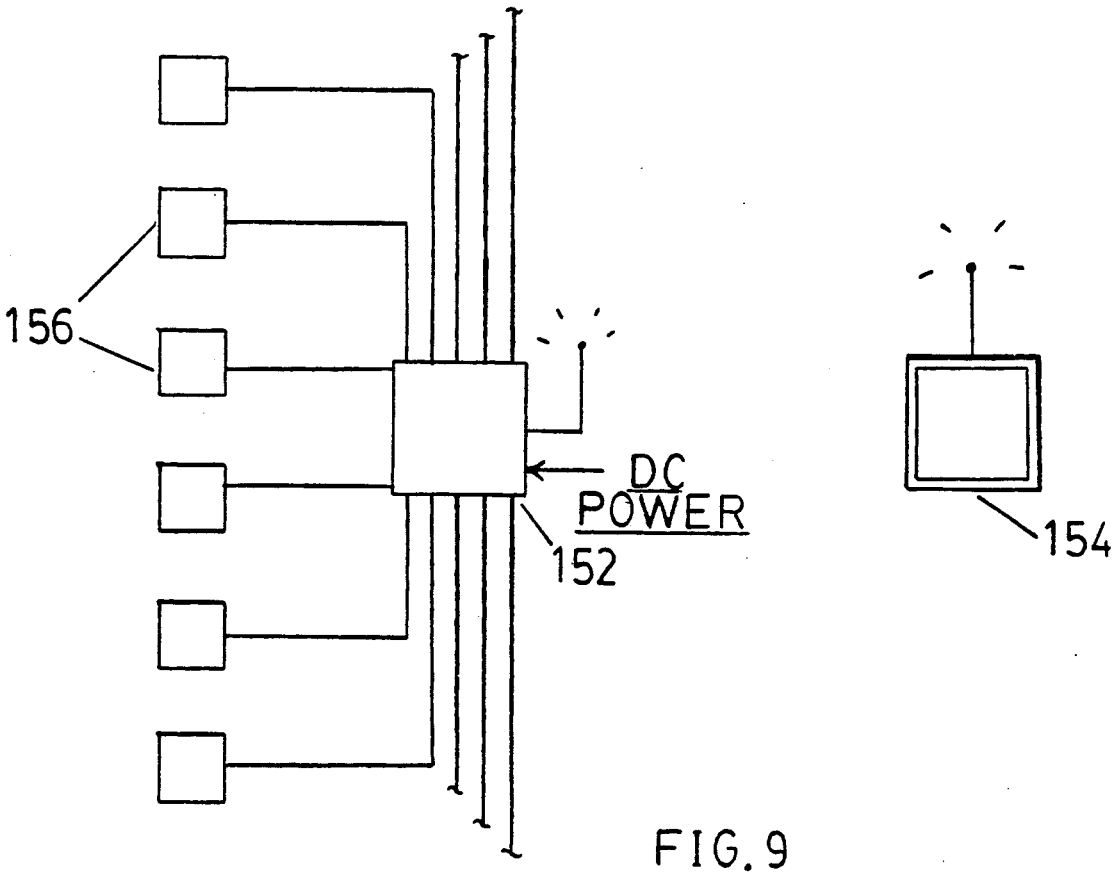
FIG. 9 is a schematic illustration of the radio control modules and valves for an alternate embodiment of the boxing robot machine.

Another embodiment of the invention is shown in FIG. 9, whereby the robot is remotely controlled by persons outside of the robot via a radio control system. In this embodiment, all the previously described solenoid valves are represented by valves 156. The electric solenoid valves 156 are operatively connected to a radio frequency receiver 152 on the robot. The receiver receives radio frequency signals from a remote transmitter 154, decodes the signals, and relays a signal to the respective solenoid valve, which in turn control the various arm functions, and mobility functions of the boxing robot machine. Thus, a person can control the operation of the robot with the transmitter 154 some 20 or 30 feet away from the robots as they contest one another. Suitable radio control systems are commercially available, and therefore the particular details construction need not be shown and illustrated.

Although the specification contains many details, these should not be construed as limiting the scope of the present invention but as to provide a preferred embodiment of this invention. Alternatively, the power generation means for the robot could either be a gasoline powered unit for outdoors, or an electric motor version which could be operated both indoors and outdoors as well. The shape, size, etc. of the robotic figure could also be altered, or modified to suit a particular requirement.

While a particular embodiment has been described and shown, it is to be understood that this description is made only by way of example and not as a limitation to the scope of the invention which is claimed below.

I claim:

1. A motorized mobile robot adapted to carry a person and articulated to simulate the sport of boxing by effecting punches and blocks upon a like robot, comprising;

a base having wheels for supporting the robot on a flat surface, propulsion means and directional control means operatively connected to said wheels for propelling and controlling the direction of movement of said robot in forward, rearward, lateral, turning, and spinning movements, an upper frame connected to said base and defining an enclosure having a generally humanoid configuration including a torso portion with internal support means for supporting a person within the enclosure in a sitting position and constructed to protect the person's body and provide visibility and ventilation and having a head portion above said torso portion, and having a shoulder region disposed generally adjacent said head portion wheel control means operatively connected to said propulsion means and said directional control means to control their operation, a pair of independently movable arm assemblies each having a shoulder portion pivotally connected, one at each side, to the shoulder region of said torso portion, an upper arm portion having an upper end pivotally connected to said shoulder portion, a forearm portion pivotally connected to a lower end of said upper arm portion, and drive means for pivoting said shoulder portions relative to said torso portion, for pivoting said upper arm portions relative to said shoulder portions, and for pivoting said forearm portions relative to said upper arm portions, arm control means operatively connected to said arm assembly drive means for controlling the pivotal movement of said arm assemblies to simulate punching and blocking movements.

2. A motorized mobile robot according to claim 1 including a cushioned pad at an outer end of each said arm assembly forearm portion configured to resemble a boxing glove for cushioning the punches delivered by said robot to a like robot.

3. A motorized mobile robot according to claim 1 including a cushioned bumper surrounding said base to cushion the impact upon one said robot colliding with a like robot.

4. A motorized mobile robot according to claim 1 in which said head portion is pivotally mounted on said torso portion such that it will pivot from an upright position to a rearward position upon a sufficient punch delivered to said robot.

5. A motorized mobile robot according to claim 4 including counter means and indicator means on said upper frame and operatively connected with said head portion for totaling and indicating the number of times said head portion has been pivoted to the rearward position.

6. A motorized mobile robot according to claim 1 including proximity sensing means on said upper frame operatively connected with said arm control means to allow operation of said arm assemblies only when one said robot is in a predetermined position relative to a like robot.

7. A motorized mobile robot according to claim 1 including timing means operatively connected with said arm control means for controlling the movement of said arm assembly drive means to control the length of time for an arm assembly movement cycle.

8. A motorized mobile robot according to claim 1 in which said wheels comprise a pair of wheel assemblies movably mounted in said base in laterally opposed relation and each independently controlled by said propulsion means and said directional control means to rotate each said wheel assembly about a vertical axis and each said wheel about its horizontal axis.

9. A motorized mobile robot according to claim 8 in which said propulsion means comprises first motor means operatively connected to each said wheel to rotate each said wheel about its horizontal axis, and said directional control means comprises second motor means operatively connected to each said wheel assembly for rotating each said wheel assembly about a vertical axis.

10. A motorized mobile robot according to claim 9 in which said wheel control means comprises a pair of joysticks within said enclosure each connected to said first motor means for controlling the direction of rotation of each said wheel about its horizontal axis, and foot pedal means operatively connected to both said second motor means for simultaneously controlling the direction of rotation of both said wheel assemblies about a vertical axis.

11. A motorized mobile robot according to claim 10 including;

a source of fluid under pressure carried in said frame, said first motor means comprises a first fluid motor connected to said fluid under pressure, a control valve operatively connected to said joysticks and to said first fluid motor to control the operation of said first fluid motor upon manipulating said joysticks, and said second motor means comprising a second fluid actuator connected to each said fluid under pressure, and said foot pedal means is operatively connected to both said second fluid actuators to control their operation.

12. A motorized mobile robot according to claim 9 in which said wheel control means comprises a radio frequency receiver within said enclosure operatively connected to said first motor means for controlling the direction of rotation of each said wheel about its horizontal axis and to both said second motor means for simultaneously controlling the direction of rotation of both said wheel assemblies about a vertical axis, and a remote radio frequency transmitter for transmitting radio frequency control signals to said receiver for controlling the operation of said first and said second motor means from a remote location.

13. A motorized mobile robot according to claim 1 in which each said arm assembly drive means comprises;

a first motor means operatively connected to said upper arm portion to pivot it relative to said torso portion about a horizontal axis, and a second motor means operatively connected to said forearm portion to pivot it relative to said upper arm portion.

14. A motorized mobile robot according to claim 13 including a source of fluid under pressure carried in said frame, said first and said second motor means comprises a first and second fluid actuator connected to said fluid under pressure, and a control valve operatively connected to each said first and said second fluid actuator to independently control the operation of each said fluid actuator.

15. A motorized mobile robot according to claim 14 in which each said control valve is operatively connected to a pushbutton disposed in said enclosure for manually controlling the movement of said upper arm and said forearm.

16. A motorized mobile robot according to claim 13 in which said arm control means comprises a radio frequency receiver within said enclosure operatively connected to said first and said second motor means for controlling the movement of said upper arm portion and said forearm portion, and a remote radio frequency transmitter for transmitting radio frequency control signals to said receiver for controlling the operation of said first and second motor means from a remote location.

17. A motorized mobile robot according to claim 13 including a third motor means operatively connected to each said arm assembly to pivot said arm assembly relative to said torso portion about a vertical axis.

18. A motorized mobile robot according to claim 17 including a source of fluid under pressure carried in said frame, each said third motor means comprising a third fluid actuator connected to said fluid under pressure, and a control valve operatively connected to each said third fluid actuator to independently control the operation of each said third fluid actuator.

19. A motorized mobile robot according to claim 18 in which each said control valve is operatively connected to a foot pedal disposed in said enclosure for manually controlling the movement of said arm assembly.

20. A motorized mobile robot according to claim 17 in which said arm control means comprises a radio frequency receiver within said enclosure operatively connected to said first, said second, and said third motor means for controlling the movement of said arm assembly, said upper arm portion, and said forearm portion, and a remote radio frequency transmitter for transmitting radio frequency control signals to said receiver for controlling the operation of said first, said second, and said third motor means from a remote location.

* * * * *